US005747821A

United States Patent [19]

York et al.

[11] Patent Number: 5,747,821

[45] Date of Patent: May 5, 1998

[54] RADIATION FOCUSING MONOCAPILLARY WITH CONSTANT INNER DIMENSION REGION AND VARYING INNER DIMENSION REGION

[75] Inventors: Brian R. York, San Jose, Calif.; Oi-fan Xiao, Albany; Ning Gao, Guilderland, both of N.Y.

[73] Assignee: X-Ray Optical Systems, Inc., Albany, N.Y.

[21] Appl. No.: 511,482

[22] Filed: Aug. 4, 1995

[51] Int. Cl.[6] ..... G21K 1/00

[52] U.S. Cl. ..... 250/505.1; 378/145

[58] Field of Search ..... 250/505.1, 504 H; 378/145, 147

[56] References Cited

U.S. PATENT DOCUMENTS

| | | | |
|---|---|---|---|
| 2,813,202 | 11/1957 | Zieler | 378/147 |
| 3,628,021 | 12/1971 | MacDonald | 378/147 |
| 3,868,513 | 2/1975 | Gonser | 250/504 H |
| 4,063,088 | 12/1977 | Dailey | 378/147 |
| 4,317,036 | 2/1982 | Wang | 378/147 |
| 4,857,730 | 8/1989 | Pierre | 378/147 |
| 4,916,720 | 4/1990 | Yamamoto et al. | 378/81 |
| 5,001,737 | 3/1991 | Lewis et al. | 378/147 |
| 5,016,267 | 5/1991 | Wilkins | 378/84 |
| 5,033,074 | 7/1991 | Cotter et al. | 378/147 |
| 5,175,755 | 12/1992 | Kumakhov | 378/34 |
| 5,192,869 | 3/1993 | Kumakhov | 250/505.1 |
| 5,497,008 | 3/1996 | Kumakhov | 250/505.1 |

OTHER PUBLICATIONS

"Capillary Optics," X-Ray Capillaty Optics AB, Sweden, 2 pages.

X-Ray Microbean Techniques, pp. 284–285 and pp. 288–289.

Gao, Ning, "Simulation of Tapered Monocapillaty Applied in Oak Ridge Microfocusing XRF Set-Up," pp. 1–4.

*Primary Examiner*—Bruce Anderson

*Attorney, Agent, or Firm*—Heslin & Rothenberg, P.C.; Wayne F. Reinke, Esq.

[57] ABSTRACT

A monocapillary has a first region of constant inner dimension where the angle of reflection remains essentially constant as radiation is guided therethrough. The monocapillary also has a second region of decreasing inner dimension in a direction toward the outlet where the radiation is guided therethrough. In another embodiment, the monocapillary also has a third region at the inlet of increasing inner dimension toward the outlet direction where the radiation is guided therethrough.

17 Claims, 7 Drawing Sheets

RADIATION FOCUSING MONOCAPILLARY WITH CONSTANT INNER DIMENSION REGION AND VARYING INNER DIMENSION REGION

This invention was made with U.S. government support under contract no. 70NANB2H1250 awarded by The Department of Commerce. The U.S. government has certain rights in the invention.

FIELD OF THE INVENTION

This invention will find use in fields where focused radiation is required. This invention will be particularly advantageous in situations requiring high precision spacial resolution of radiation, for example, x-ray or neutron beams. Another area of application is the analysis of very small samples where intense focused short wavelength radiation is advantageous.

BACKGROUND OF THE INVENTION

In the analysis of the structural morphology, or elemental composition of sample materials, it is often desirable to radiate the sample with short wavelength radiation beams. For relatively large samples, a small beam size can give improved spacial resolution. Where small samples are concerned, a small beam is useful to cut down on background radiation. In addition, a higher flux at the sample is also useful. If the incident radiation has short wavelengths, such as x-rays or neutrons, which can undergo total external reflections, the use of optical devices which comprise one or more hollow channels can be quite advantageous. In the context of this family of devices, the type chosen depends on the size of the output beam required. Multiple-fiber polycapillary optics of the type disclosed in U.S. Pat. No. 5,192,869 issued to Kumakhov and entitled, "Device for Controlling Beams of Particles, X-Ray and Gamma Quanta", which is herein incorporated by reference in its entirety, efficiently produce focused output beam sizes of about 500 micrometers or more. For these devices, the minimum output beam spot at the focal point is primarily limited by the outer diameter of the individual fibers. Smaller output focused spot sizes, down to roughly 20 micrometers, can be obtained by the use of monolithic, or single-piece, multiple-channel optics. These devices are also disclosed in U.S. Pat. No. 5,192,869. The minimum output beam size of these optics is essentially determined by the critical angle of total reflection of the incident radiation, and the distance of the focused spot from the output end of the optic. If still smaller short wavelength radiation spot sizes are desired, capillary optic devices with a single hollow channel, so-called monocapillaries, can be used. Because the minimum spot size from the monocapillaries is located right at the channel's outlet end, the output beam size is roughly determined by the size of the channel at that point.

Hollow capillaries can effectively guide short wavelength radiation such as x-rays, or neutron beams because glancing angle reflections with smooth inner channel walls are highly reflective. Usually, several reflections are required for the radiation to traverse the capillary; the number of reflections depending on the radiation's incident angle, the capillary's inner channel diameter, and the overall capillary length. Only radiation with incident angles less than the critical angle of total external reflection can be guided. Critical angles depend on the reflecting material and incident photon energy. For example, a material of glass has critical angles on the order of two degrees or less for x-ray or neutron radiation. However, reflections are never perfect. Even for incident angles less than the critical angle for total external reflection there are losses associated with absorption and roughness scattering. Thus, more reflections generally lead to increased loss of radiation flux.

Monocapillary optic devices with hollow channels of constant dimension are well known to the art. When used with divergent sources, these optics can deliver a short wavelength radiation beam away from the source without the associated $1/R^2$ intensity loss. Also known to the art are monocapillaries whose inner dimensions are tapered along the entire length. Tapering the inner radiation transmitting channel allows the incident radiation to be squeezed, or funneled into a smaller, more intense and tightly focused beam. Assuming perfectly smooth channel surfaces and for a given capillary material, capillary transmission efficiency depends on the channel's taper shape. Taper shapes such as linear, parabolic, or elliptic tapered capillaries are well known. All tapered monocapillaries known to the art taper along the full length of the capillary—although the taper may not be constant. One limitation of linear taper devices is that, because of the taper, the capture angle of the capillary channel decreases for diverging radiation from point sources. In addition, each successive reflection within the channel occurs at an increasing incident angle. This can lead to more reflections before the radiation exits the channel, and an increase in radiation intensity loss. Thus, taper angles are typically very small, and the devices can be quite long. This makes manufacturing difficult to control and expensive. In addition, because of the reduced capture angles, these devices are less than ideal when used with point sources of radiation.

It is well known in the art that for the purpose of transmitting radiation which originates from point sources, the preferred channel taper shape is full elliptic. With a perfect full elliptic shape, and a point source placed at one focus, each x-ray that strikes the inner channel wall at an incident angle less than the critical angle, reflects a single time and exits the capillary through the channel's output end. The x-rays then cross at the second ellipse focus. However, the formation of effective full elliptical tapers has proven to be extremely difficult. As a result, most tapered capillaries in use today employ essentially linear tapers, however, parabolically tapered capillaries are commercially available.

Also known to the art are capillaries whose taper angles change in a series of abrupt steps. See, for example, U.S. Pat. No. 5,001,737 issued to Lewis et al. on Mar. 19, 1991, entitled "Focusing and Guiding X-Rays With Tapered Capillaries." The goal of Lewis et al. is to effectively approximate an elliptically bent inner channel. In the previous art, as described in Lewis et al., the inner capillary diameters are either constant for the whole capillary length, or change in some fashion over the whole capillary length.

OBJECTS OF THE INVENTION

It is the object of the subject invention to address the long-felt need in the art to provide a more efficient monocapillary design to better transmit incident radiation from divergent radiation sources. It is another object of this invention to provide small, intense output radiation beams with diameters of about 50 micrometers or less. Another object of this invention is to improve the ability of monocapillary optics to collect incident short wavelength radiation. Yet another object of this invention is to achieve these objectives in a cost effective, and relatively easily manufacturable way.

SUMMARY OF THE INVENTION

The invention comprises, in a first aspect, an apparatus for focusing short wavelength radiation, such as x-rays or neutrons, which comprises a monocapillary. The monocapillary channel has an inlet for the collection of incident short wavelength radiation, and an outlet which allows the radiation to exit the channel. The monocapillary further comprises a first region in which the radiation-transmitting channel is of constant inner dimension along the length thereof, and at least one other region of varying inner dimension along the length thereof. The at least one other region of varying inner dimension is shorter in length than the first region.

The invention comprises, in a second aspect, a method of focusing short wavelength radiation in a monocapillary having an inlet, an outlet, a first region of constant inner dimension along the length thereof and at least one other region of varying inner dimension along the length thereof, where the at least one other region is shorter in length than the first region. The method comprises emitting a short wavelength radiation from a source such that the radiation enters the monocapillary at the inlet, guiding the radiation through the first region such that an incident angle for each internal reflection remains approximately constant, and guiding the radiation through the at least one other region such that an incident angle for each internal reflection is different.

BEST MODE FOR CARRYING OUT THE INVENTION

As used herein, the term "radiation" refers to radiation or particles which, when incident on a material at or below an angle of critical value, undergoes essentially total external reflection. The term "radiation" includes, but is not limited to, neutral particles (e.g., neutrons), charged particles, and x-rays. As used herein, the term "reflective optic" refers to optics which function as a result of one or more essentially total external reflections.

Figure 1A:
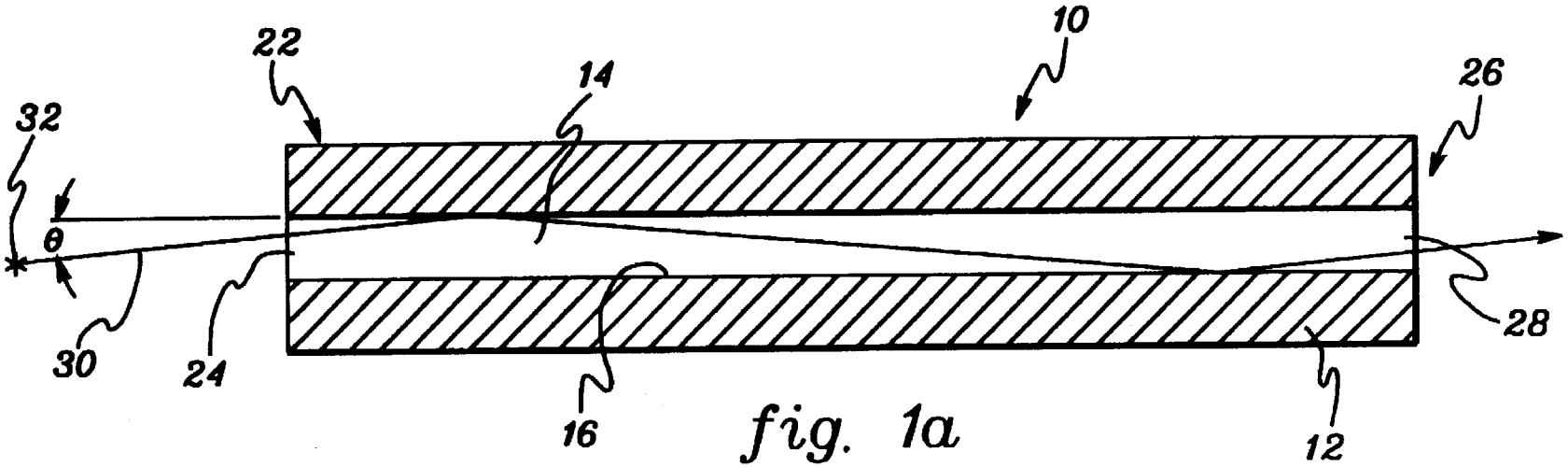
FIG. 1*a* is a schematic diagram of a monocapillary.
Figure 1B:
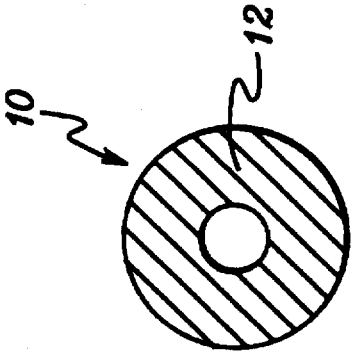
FIG. 1*b* is a cross-sectional view of the input, or output end of the monocapillary of FIG. 1*a*.

FIG. 1*a* is a schematic diagram of a single-channel or monocapillary device 10. The monocapillary device comprises an elongated piece of suitable material 12, within which a single, constant-dimension, hollow radiation-transmitting channel 14, runs in a generally longitudinal direction. The inner walls 16, of channel 14 are smooth, and enable the efficient reflection of short wavelength radiation such as, for example, x-rays or a neutron beam. The channel is connected to the outside world at the input end 22, by inlet 24, and at the output end 26, by outlet 28. Incident radiation 30, which originates from radiation source 32, is accepted into, and expelled from the channel at the inlet and outlet ends, respectively. Radiation 30, incident at angle $\theta<\theta_c$, where $\theta_c$ is the critical angle for total external reflection, traverse capillary device 10 by making successive total external reflections with the smooth inner walls 16 of channel 14. Critical angles depend on the type and energy of the incident radiation, as well as on the material from which the capillary is made. It is generally advantageous to choose capillary materials which give relatively large critical angles, and display low radiation absorption. Radiation with incident angles greater than the critical angle for total reflection are transmitted into the capillary material where it is most likely absorbed. If the effects of surface roughness scattering are neglected, the incident angle for each reflection in constant-dimension channels is approximately constant. Because it provides the smooth inner surfaces 16, required for efficient reflection, glass is a typical capillary device construction material. FIG. 1*b* is a cross-sectional view of capillary device 10.

Figure 2:
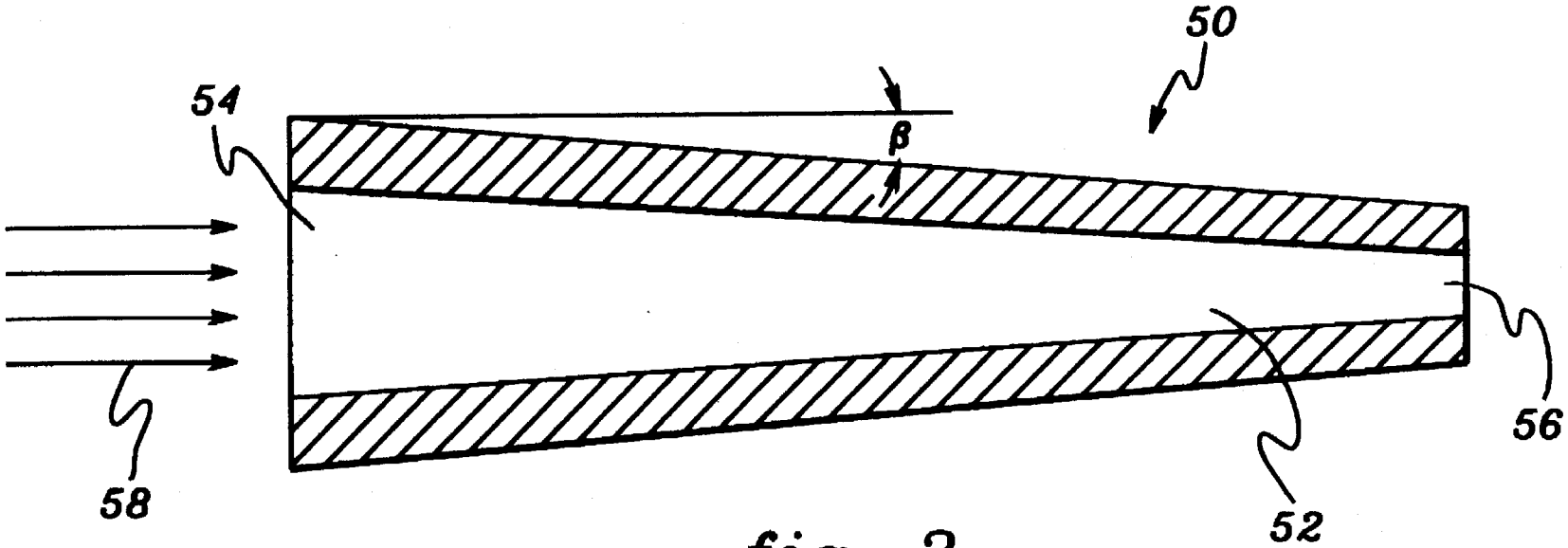
FIG. 2 ia a schematic diagram of a monocapillary tapered along the length thereof.

FIG. 2 shows a single-channel monocapillary optic device 50, with tapered inner channel 52. The taper begins at input end 54, and continues uninterrupted to output end 56. The taper angle $\beta$ is typically less than the critical angle for total external reflection of the radiation type and energy for which the device is designed. It should be noted that, in contrast to the constant-dimension monocapillary described above, incident angles increase with each reflection as the radiation traverses the tapered capillary, which increases the radiation intensity losses. In addition, if used with divergent radiation sources, such as point sources, the capture angle of the capillary channel decreases because of the taper. Thus, tapered capillaries of this type are useful where the incident radiation 58, is essentially parallel, as in the case of synchrotron radiation.

Figure 3:
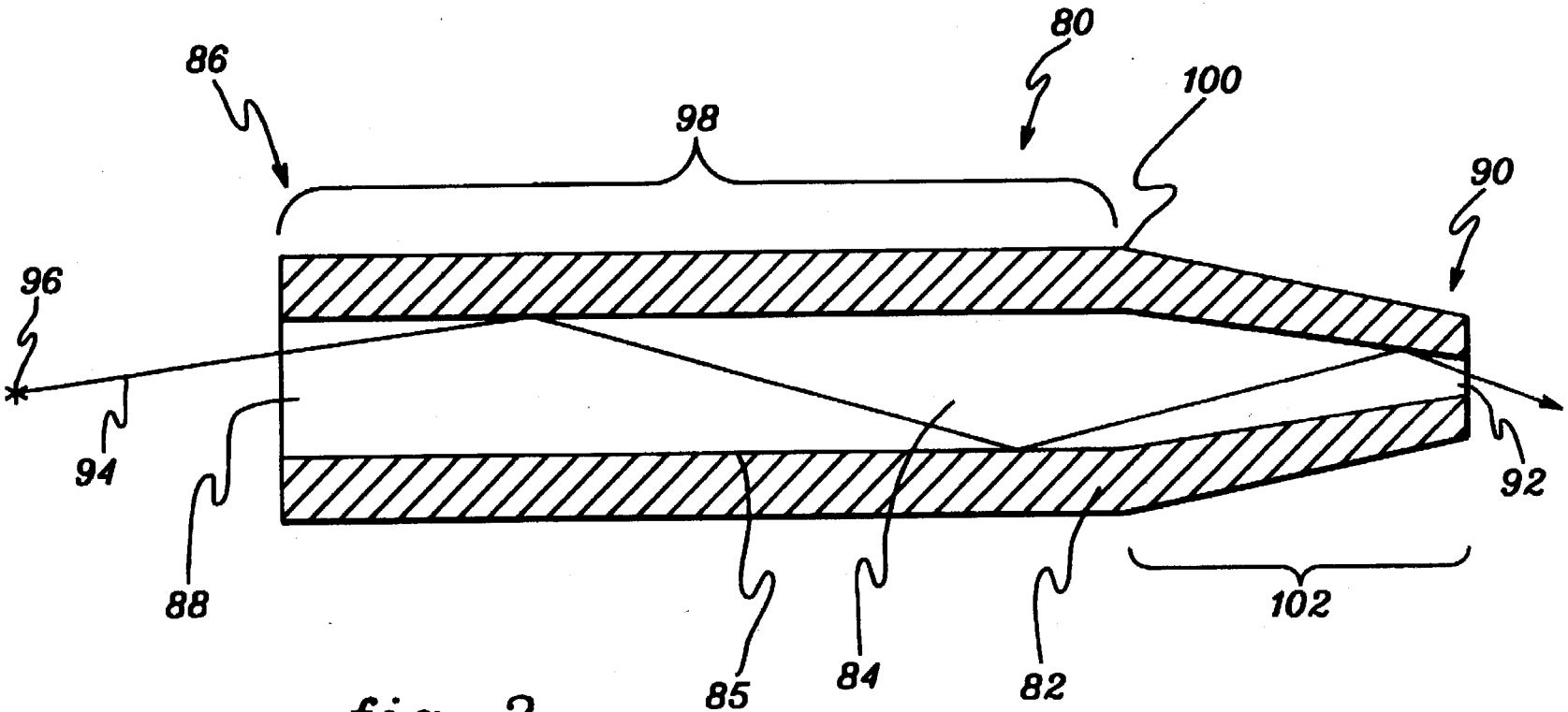
FIG. 3 is a schematic diagram of the first preferred embodiment of the subject invention.
Figure 7:
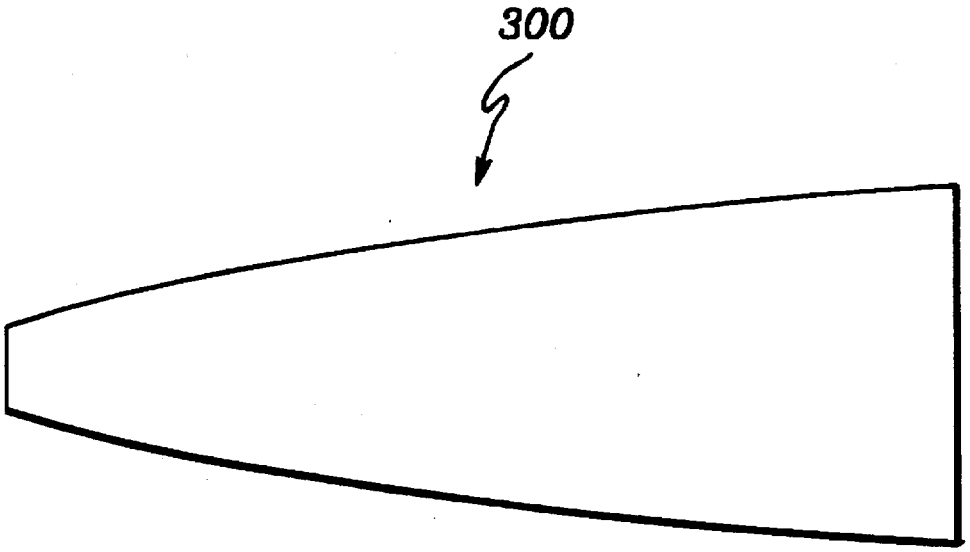
FIG. 7 is a schematic diagram of a parabolically tapered monocapillary.
Figure 8:
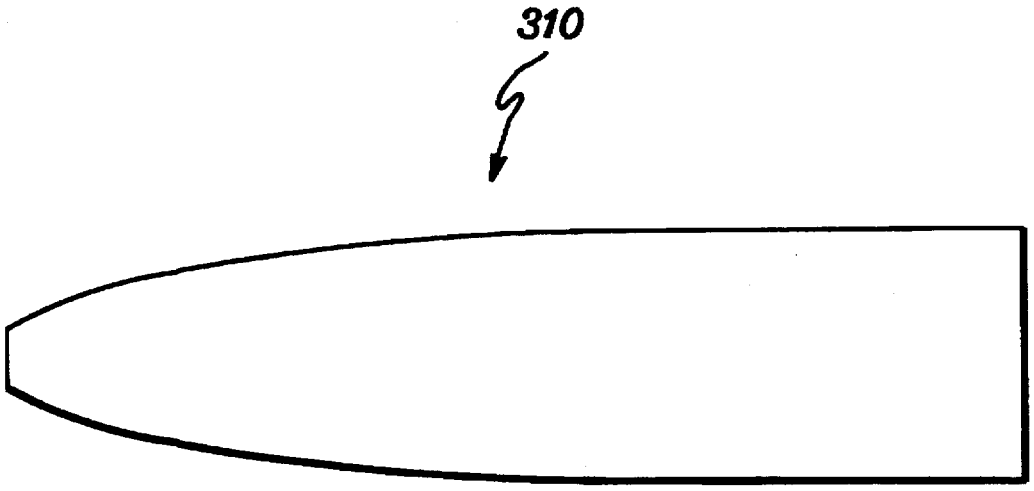
FIG. 8 is a schematic diagram of an elliptically tapered monocapillary.

FIG. 3 shows a schematic diagram of a first preferred embodiment of the subject invention, a monocapillary optic device 80. Monocapillary optic device 80 comprises an elongated piece of suitable material 82, within which a single, hollow, radiation-transmitting channel 84, runs in a generally longitudinal direction. The channel 84 is shaped by the inside wall 85 of monocapillary optic device 80, and is connected to the outside world at input end 86, by inlet 88, and at the output end 90, by outlet 92. Incident radiation 94, which originates from a generally divergent radiation source 96, is accepted into, and departs from channel 84 at the inlet and outlet ends, respectively. Channel 84 is typically roughly circular in cross-section, although other cross-sectional shapes, such as, for example, rectangular are also possible. The channel in this first embodiment of the subject invention consists of essentially two smoothly connected longitudinal regions. The first region 98, which begins at channel inlet 88, and ends generally at boundary area 100 is of constant inner dimension. The second region 102, is of variable dimension. This second region begins at the end of the first region, roughly at area 100, and continues to the channel outlet 92. In this example, the second region displays a linearly tapered dimension. The second region will usually be tapered such that the cross-sectional dimension of the channel decreases to the outlet, however, it need not. In addition to linear tapers, elliptical, parabolic, or any other taper shapes can be used. FIGS. 7 and 8 depict a parabolically tapered monocapillary 300 and elliptically tapered monocapillary 310, respectively. For the case of a linearly tapered second region, the taper angle is preferably less than the critical angle of total reflection for the radiation being transmitted. It will be understood that the first and second regions could be switched, i.e., the variable-dimension region being at the inlet end and the constant-dimension region being at the outlet end. It will also be understood that the variable-dimension region could flair out, rather than decrease in size, as shown in FIG. 3.

The best mode for carrying out the first embodiment of the subject invention depends on parameters such as, desired output diameter, radiation source size, source input distance, etc . . . , which define the application. The following two tables summarize exemplary best modes for two taper profiles and two output diameters (circular channels are used). Table I is for an outlet diameter of 8 μm, and Table II is for an outlet diameter of 3 μm. The results are with respect to a single-channel linear monocapillary (i.e., having no taper). Linear tapered results are also included for comparison. All results are from computer simulations for a roughly 50 micron by 5 micron source emitting primarily 8 keV x-rays, and the total length of each capillary is about 100 mm. Looking now at the last column in each table, it will be seen that two specific channel configurations of the subject invention herein described, straight/linear and straight/elliptic, show excellent output radiation intensity gains as compared to the prior art. Increased intensity of small, focused short wavelength radiation is another aspect of the subject invention.

TABLE I

| 8 μm Outlet Diameter | | | | | |
|---|---|---|---|---|---|
| TAPER TYPE | SOURCE/ INPUT DISTANCE | INLET DIAMETER | REGION I LENGTH | REGION II LENGTH | GAIN |
| none | 2.0 mm | 8 μm | 100 mm | — | 1.0 |
| linear | 2.0 mm | 14 μm | 100 mm | — | 1.5 |
| straight/ liner | 2.0 mm | 25 μm | 97 mm | 3 mm | 2.7 |
| straight/ elliptic | 2.0 mm | 25 μm | 96 mm | 4 mm | 3.1 |

TABLE II

| 3 μm Outlet Diameter | | | | | |
|---|---|---|---|---|---|
| TAPER TYPE | SOURCE/ INPUT DISTANCE | INLET DIAMETER | REGION I LENGTH | REGION II LENGTH | GAIN |
| none | 2.0 mm | 3 μm | 100 mm | — | 1.0 |
| linear | 2.0 mm | 9 μm | 100 mm | — | 3.0 |
| straight/ liner | 2.0 mm | 15 μm | 98 mm | 2 mm | 8.0 |
| straight/ elliptic | 2.0 mm | 15 μm | 96 mm | 4 mm | 10.0 |

Figure 4:
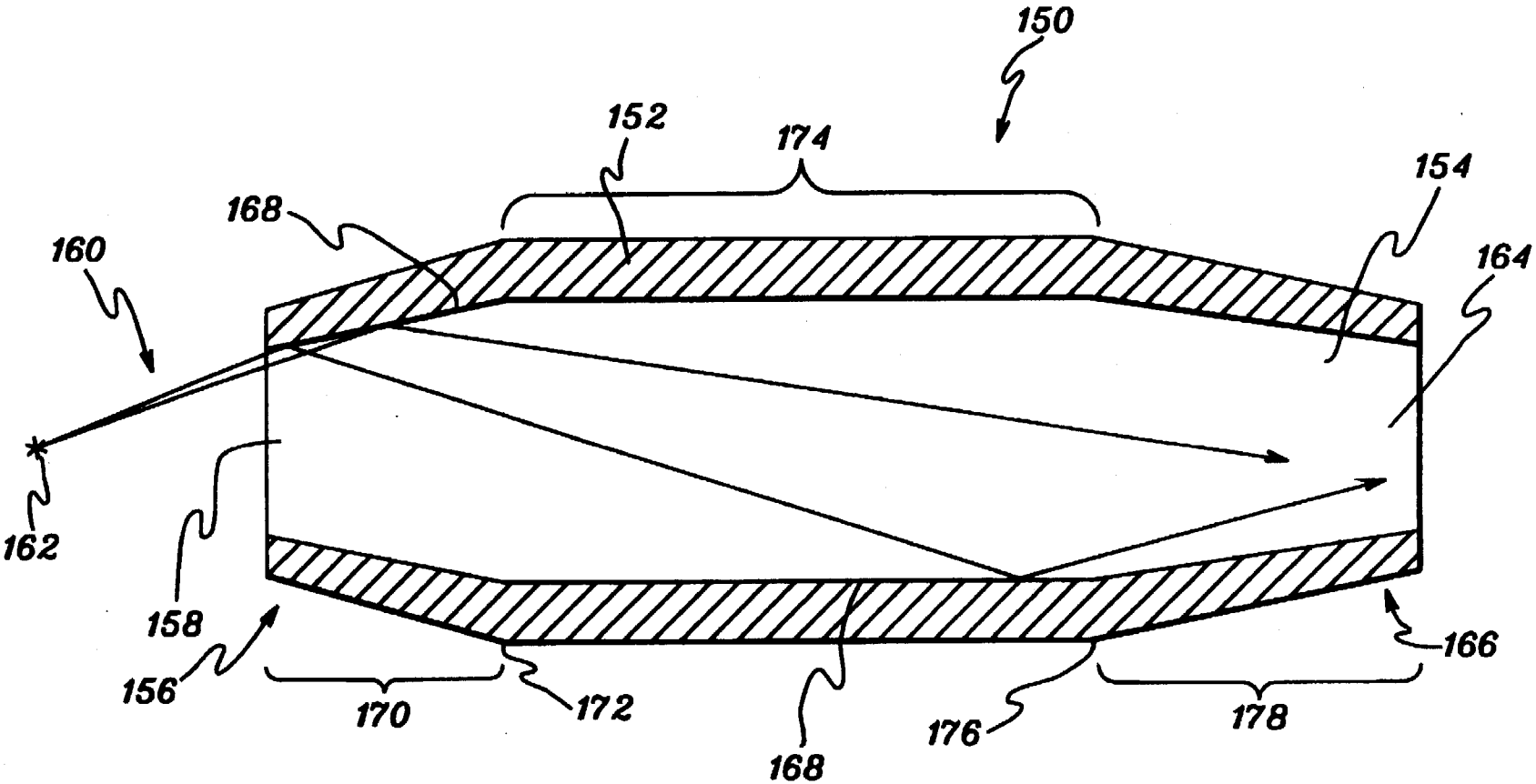
FIG. 4 is a schematic diagram of the second preferred embodiment of the subject invention.

FIG. 4 shows a schematic diagram of a second preferred embodiment of the subject invention, a monocapillary optic device 150, for forming small dimension, intense short wavelength radiation beams. The capillary configuration comprises an elongated piece of suitable capillary construction material 152, within which a hollow channel 154, shaped by the inner walls of capillary 150, runs in a generally longitudinal direction. Because of the ease of construction, glass is a preferred capillary material, but other materials which are capable of forming smooth inner channel surfaces can be used. The capillary has input end 156, with channel inlet 158, which is capable of accepting radiation 160 originating from radiation source 162. Radiation 160 exits channel 154 through outlet 164, which is located at the output end 166, of the capillary. Radiation which strikes smooth inner channel walls 168, at incident angles less than the critical angle for total external reflection can be transmitted through the capillary channel. This second embodiment differs from the first in that there are now three distinct longitudinal channel regions, in which the cross-sectional channel profiles can be different. The first channel region 170, begins at the input end 156 of the capillary, and continues roughly to boundary area 172. In this first region, the channel cross-section increases from a minimum at capillary input end 156, to a maximum at about area 172. The configuration shown in FIG. 4 has a linear increase in diameter, but other configurations, such as, for example, parabolic, elliptical or with an increase in channel dimension are also possible. In addition, as with FIG. 3, it will be understood that the variable-dimension regions could flair out, and the arrangement of the various sections could be different.

Figure 5:
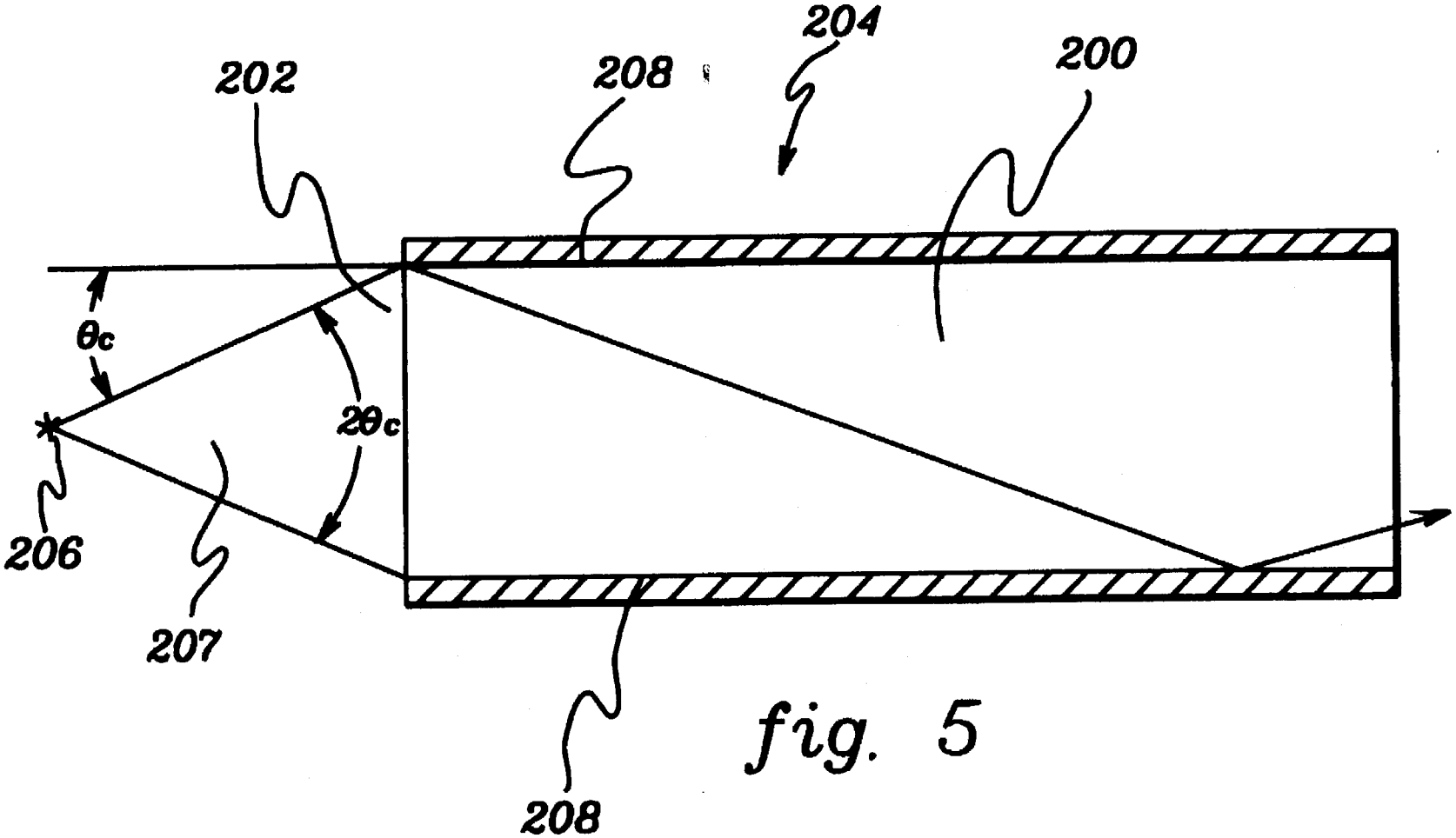
FIG. 5 is a schematic diagram showing the acceptance of radiation at the inlet of a linear monocapillary.

The effect of this changing inner dimension is demonstrated in FIG. 5. FIG. 5 shows a channel 200 with a constant dimension at the inlet 202 of a linear monocapillary 204. If radiation source 206 is approximately a point source, then only radiation within a cone 207, of angle $2\theta_c$, where $\theta_c$ is the radiation's critical angle for total reflection on the inner channel walls 208, can be accepted and transmitted by channel 200. This represents the maximum radiation capture angle of the capillary channel.

Figure 6:
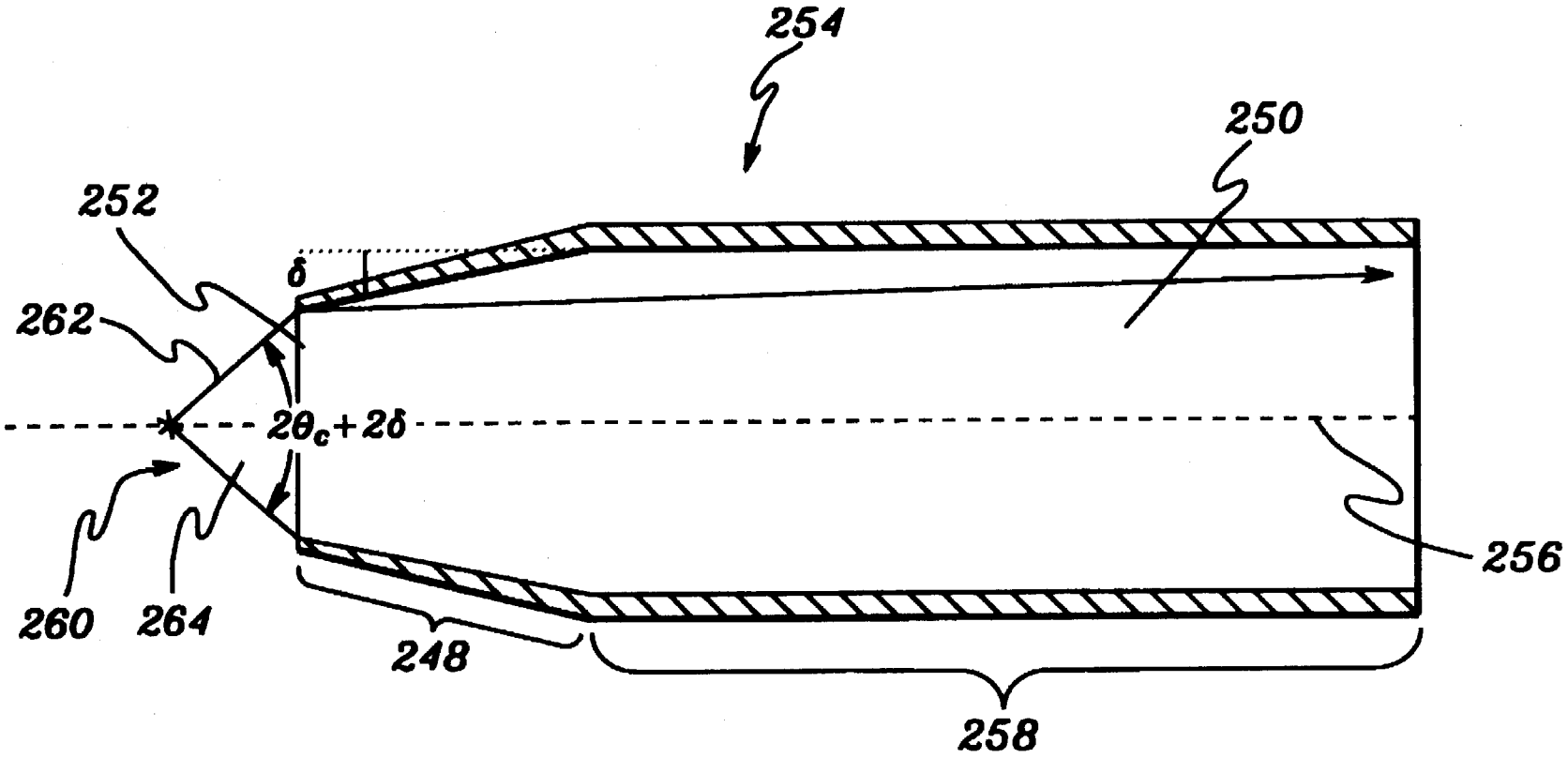
FIG. 6 is a schematic diagram showing the acceptance of radiation at the inlet of a monocapillary with the inner channel dimension of the inlet increasing in a direction away from the opening and becoming linear.

FIG. 6 shows a channel 250 which has a region 248 of increasing dimension at the input end 252 of monocapillary 254. In this figure, the inner channel dimension increases linearly with longitudinal distance along capillary axis 256; the taper making angle $\delta$ with a continuation of a constant inner-dimension region 258, of the capillary. Other taper configurations are also possible, such as, for example, elliptic or parabolic. It will be seen from the figure that the cone 264 of acceptable radiation, is increased by an amount $2\delta$, compared to the case of FIG. 5. Thus, the capillary is better able to collect radiation from a divergent point-like source. This can result in an increase of radiation intensity which exits the channel.

Returning now to FIG. 4, the second region 174, which begins at the end of the first region 170, is of approximately constant inner dimension, and ends roughly at boundary area 176. The third channel region 178, begins at the end of the second region at about area 176 and continues to the capillary output end 166. The third region 178 is of varying inner dimension. In the figure, the varying dimension is in the form of a linear taper, but other configurations, such as, for example, elliptical, parabolic or tapers are also possible. The longitudinal lengths of first region 170, and third region 178 are shorter than region 174 of roughly constant inner dimension.

Upon reading the above specification, variations and alternative embodiments may become known to those skilled in the art and are to be considered within the scope and spirit of the subject invention. The subject invention is only to be limited by the claims which follow and their equivalents.

What is claimed is:

1. Apparatus for focusing short wavelength radiation, comprising a hollow monocapillary having an inlet and an outlet, said short wavelength radiation entering at said inlet and exiting at said outlet, said monocapillary comprising:

a first region of constant inner dimension along the length thereof; and at least one other region of varying inner dimension along the length thereof, wherein said at least one other region is shorter in length than said first region, and wherein an inner surface of each of said first region and said at least one other region is generally smooth for essentially total external reflection and made of a material that minimizes absorption of short wavelength radiation.

2. The apparatus of claim 1 wherein said at least one other region is adjacent said first region.

3. The apparatus of claim 2 wherein said first region comprises said inlet and said at least one other region comprises said outlet.

4. The apparatus of claim 1 wherein said at least one other region comprises a second region and a third region.

5. The apparatus of claim 4, wherein said second region comprises said inlet, wherein said third region comprises said outlet and wherein said first region lies between said second region and said third region.

6. The apparatus of claim 1 wherein said at least one other region comprises a linearly tapered region.

7. The apparatus of claim 1 wherein said at least one other region comprises an elliptically tapered region.

8. The apparatus of claim 1 wherein said at least one other region comprises a parabolically tapered region.

9. The apparatus of claim 1 wherein said at least one other region comprises a tapered region.

10. The apparatus of claim 1 wherein said outlet is smaller in inner dimension than said inlet.

11. The apparatus of claim 1, wherein said material comprises glass.

12. A method of focusing short wavelength radiation in a hollow monocapillary having a circular cross-section, an inlet, an outlet, a first region of constant diameter along the length thereof and at least one other region of varying diameter along the length thereof, wherein said at least one other region is shorter in length than said first region, said method comprising steps of:

emitting short wavelength radiation from a source such that said short wavelength radiation enters said monocapillary at said inlet;

guiding said short wavelength radiation through said first region by essentially total external reflection such that an incident angle for each reflection remains approximately constant; and guiding said short wavelength radiation through said at least one other region by essentially total external reflection such that an incident angle for each reflection is different.

13. The method of claim 12, wherein said first region comprises said inlet, wherein said at least one other region comprises a second region, said second region comprising said outlet, wherein said first step of guiding comprises guiding said short wavelength radiation from said inlet through said first region, and wherein said second step of guiding comprises guiding said short wavelength radiation through said second region to said outlet.

14. The method of claim 13, wherein said varying diameter of said second region decreases in a direction toward said outlet, and wherein said second step of guiding comprises guiding said short wavelength radiation through said second region such that said incident angle for each reflection increases in said direction.

15. The method of claim 13, wherein said varying diameter of said second region increases in a direction toward said outlet, and wherein said second step of guiding comprises guiding said short wavelength radiation through said second region such that said incident angle for each reflection decreases in said direction.

16. The method of claim 12, wherein said at least one other region comprises a second region and a third region, said first region lying between said second region and said third region, wherein said second region comprises said inlet and said third region comprises said outlet, and wherein said second step of guiding comprises steps of:

(a) guiding said short wavelength radiation from said inlet through said second region; and (b) guiding said short wavelength radiation through said third region to said outlet.

17. The method of claim 16, wherein said varying diameter of said second region increases in a direction toward said outlet, wherein said varying diameter of said third region decreases in said direction, wherein said step (a) comprises guiding said short wavelength radiation such that said incident angle for each reflection decreases in said direction, and wherein said step (b) comprises guiding said short wavelength radiation such that said incident angle for each reflection increases in said direction.

* * * * *

UNITED STATES PATENT AND TRADEMARK OFFICE

CERTIFICATE OF CORRECTION

PATENT NO. : 5,747,821

DATED : May 5, 1998

INVENTOR(S) : York et al.

It is certified that error appears in the above-identified patent and that said Letters Patent is hereby corrected as shown below:

On the title page: Item

[75] Inventors: "Oi-fan Xiao, Albany;" should be –Qi-fan Xiao, Albany;–.

Signed and Sealed this

First Day of September, 1998

*Attest:*

*Attesting Officer*

BRUCE LEHMAN

*Commissioner of Patents and Trademarks*